US006520749B2

(12) United States Patent
Kimura et al.

(10) Patent No.: US 6,520,749 B2
(45) Date of Patent: Feb. 18, 2003

(54) CONTROL VALVE FOR VARIABLE DISPLACEMENT COMPRESSOR

(75) Inventors: Kazuya Kimura, Kariya (JP); Satoshi Umemura, Kariya (JP); Kazuhiko Minami, Kariya (JP); Tatsuya Hirose, Kariya (JP); Taku Adaniya, Kariya (JP); Atsuhiro Suzuki, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/946,693

(22) Filed: Sep. 5, 2001

(65) Prior Publication Data

US 2002/0067994 A1 Jun. 6, 2002

(30) Foreign Application Priority Data

Sep. 5, 2000 (JP) ..... 2000-268956

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3

(56) References Cited

U.S. PATENT DOCUMENTS 6,336,335 B2 * 1/2002 Ota et al. ..... 123/198 R
6,371,734 B1 * 4/2002 Ota et al. ..... 417/222.2
6,382,926 B2 * 5/2002 Ota et al. ..... 417/222.2
6,385,979 B2 * 5/2002 Ota et al. ..... 62/115
6,386,834 B1 * 5/2002 Kimura et al. ..... 417/222.2
6,447,258 B2 * 9/2002 Ota et al. ..... 417/222.2
2001/0002237 A1 * 5/2001 Ota et al. ..... 417/222.2
2001/0008131 A1 * 7/2001 Ota et al. ..... 123/339.17
2001/0013225 A1 * 8/2001 Ota et al. ..... 62/228.5
2001/0014287 A1 * 8/2001 Ota et al. ..... 417/213
2001/0027658 A1 * 10/2001 Ota et al. ..... 62/228.3
2001/0027659 A1 * 10/2001 Ota et al. ..... 62/228.3
2001/0052236 A1 * 12/2001 Ota et al. ..... 62/228.3
2001/0055531 A1 * 12/2001 Ota et al. ..... 417/222.2
2002/0011074 A1 * 1/2002 Suitou et al. ..... 62/228.3
2002/0031432 A1 * 3/2002 Ota et al. ..... 417/222.2
2002/0035842 A1 * 3/2002 Suitou et al. ..... 62/228.3
2002/0037223 A1 * 3/2002 Suitou et al. ..... 417/222.2
2002/0064467 A1 * 5/2002 Ota et al.

FOREIGN PATENT DOCUMENTS

JP 11-324930 11/1999 ..... F04B/49/00

OTHER PUBLICATIONS

U.S. patent application Ser. No. 09/816,635, Ota et al., filed Dec. 27, 2001.

* cited by examiner

*Primary Examiner*—Charles G. Freay
*Assistant Examiner*—William H. Rodriguez
(74) *Attorney, Agent, or Firm*—Morgan & Finnegan, LLP

(57) ABSTRACT

A control valve is located in a variable displacement compressor, which is used in a refrigerant circuit. The control valve includes a pressure-sensing member. The pressure sensing member moves a valve body in accordance with the pressure difference between a first pressure monitoring point and a second pressure monitoring point, which are located in the refrigerant circuit. A first spring and a second spring urge the pressure-sensing member in one direction. The spring constant of the first spring is smaller than that of the second spring. A solenoid urges the pressure-sensing member by a force, the magnitude of which corresponds to an external command. The solenoid urges the pressure-sensing member in a direction opposite to the direction in which the springs urge the pressure-sensing member. The control valve quickly and accurately controls the displacement of the compressor.

20 Claims, 7 Drawing Sheets

CONTROL VALVE FOR VARIABLE DISPLACEMENT COMPRESSOR

BACKGROUND OF THE INVENTION

The present invention relates to a displacement control valve for controlling displacement of a variable displacement compressor, which is used in a refrigerant circuit of a vehicle air conditioner and changes the displacement based on the pressure in a crank chamber.

A typical refrigerant circuit (refrigeration cycle) in a vehicle air-conditioner includes a condenser, an expansion valve, which functions as a decompression device, an evaporator and a compressor. The compressor draws refrigerant gas from the evaporator, then, compresses the gas and discharges the compressed gas to the condenser. The evaporator performs heat exchange between the refrigerant in the refrigerant circuit and the air in the passenger compartment. The heat of air at the evaporator is transmitted to the refrigerant flowing through the evaporator in accordance with the thermal load or the cooling load. Therefore, the pressure of refrigerant gas at the outlet of or the downstream portion of the evaporator represents the cooling load.

Variable displacement compressors are widely used in vehicles. Such compressors include a displacement control mechanism that operates to maintain the pressure at the outlet of the evaporator, or the suction pressure, at a predetermined target level (target suction pressure). The control mechanism feedback controls the displacement of the compressor, or the inclination angle of a swash plate, by referring to the suction pressure such that the flow rate of refrigerant in the refrigerant circuit corresponds to the cooling load.

A typical displacement mechanism includes a displacement control valve, which is called an internally controlled valve. The internally controlled valve detects the suction pressure by means of a pressure sensitive member such as a bellows and a diaphragm. The internally controlled valve moves a valve body by the displacement of the pressure-sensing member to adjust the valve opening size. Accordingly, the pressure in a swash plate chamber (a crank chamber), or the crank chamber pressure is changed, which changes the inclination of the swash plate.

However, an internally controlled valve that has a simple structure and a single target suction pressure cannot respond to the changes in air conditioning demands. Therefore, there exist control valves having a target suction pressure that can be changed by external electrical control. A typical electrically controlled control valve is a combination of an internally controlled valve and an actuator such as an electromagnetic solenoid, which generates an electrically controlled force. In such a control valve, mechanical spring force, which acts on the pressure-sensing member, is externally controlled to change the target suction pressure.

In a displacement control procedure in which the suction pressure is used as a reference, changing of the target suction pressure by electrical control does not always quickly change the actual suction pressure to the target suction pressure. This is because whether the actual suction pressure quickly seeks a target suction pressure when the target suction pressure is changed depends greatly on the cooling load on the evaporator. Therefore, even if the target suction pressure is finely and continuously controlled by controlling the current to the control valve, changes in the compressor displacement are likely to be too slow or too sudden.

SUMMARY OF THE INVENTION

Accordingly, it is an objective of the present invention to provide a control valve for a variable displacement compressor that improves the controllability and response of displacement control.

To achieve the foregoing and other objectives and in accordance with the purpose of the present invention, a control valve for controlling the displacement of a variable displacement compressor used in a refrigerant circuit is provided. The compressor includes a crank chamber and a pressure control passage, which is connected to the crank chamber. The displacement of the compressor changes in accordance with the pressure in the crank chamber. The control valve adjusts the opening size of the pressure control passage, thereby controlling the pressure in the crank chamber. The control valve includes a valve housing, a valve body, a pressure-sensing chamber, a pressure-sensing member, a first urging member, a second urging member and an actuator. The valve body is accommodated in the valve housing. The valve body adjusts the opening size of the pressure control passage. The pressure-sensing chamber is defined in the valve housing. The pressure-sensing member divides the pressure-sensing chamber into a first pressure chamber and a second pressure chamber. The first pressure chamber is exposed to the pressure at a first pressure monitoring point, which is located in the refrigerant circuit. The second pressure chamber is exposed to the pressure at a second pressure monitoring point, which is located in the refrigerant circuit. The pressure at the first pressure monitoring point is higher than the pressure at the second pressure monitoring point. The pressure-sensing member actuates the valve body in accordance with the pressure difference between the pressure chambers, thereby controlling the displacement of the compressor such that fluctuations of the pressure difference between the pressure chambers are cancelled. The first urging member urges the pressure-sensing member from one of the pressure chambers toward the other one of the pressure chambers. The second urging member urges the pressure-sensing member in the same direction as the first urging member urges the pressure-sensing member. The actuator urges the pressure-sensing member by a force, the magnitude of which corresponds to an external command.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve in a variable displacement swash plate type compressor, which is used in a refrigerant circuit of a vehicle air conditioner will now be described with reference to FIGS. 1 to 6.

Figure 1:
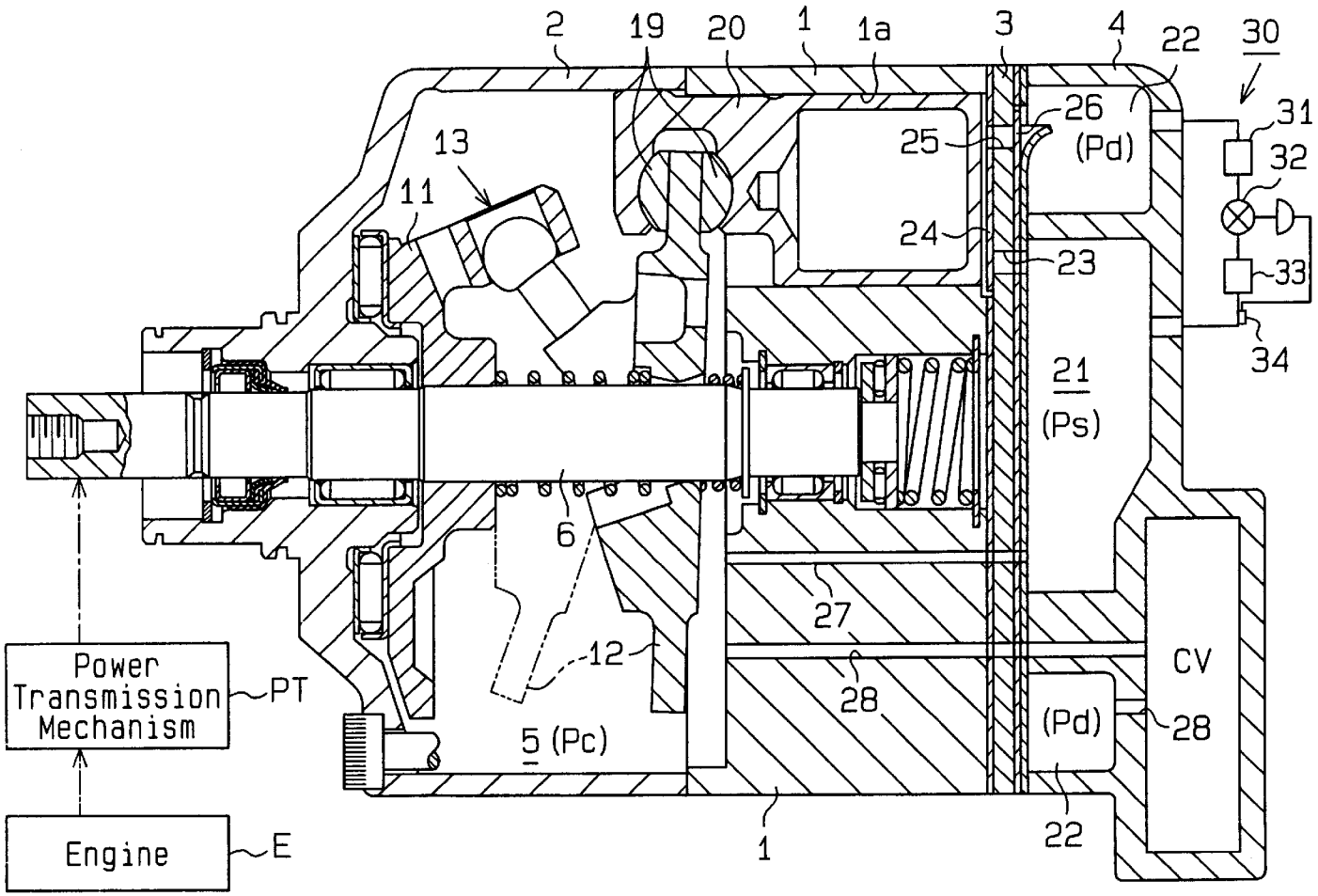
FIG. 1 is a cross-sectional view illustrating a variable displacement control valve according to a first embodiment of the present invention.

As shown in FIG. 1, the compressor includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1.

A crank chamber 5 is defined between the cylinder block 1 and the front housing member 2. A drive shaft 6 is extends through the crank chamber 5 and is rotatably supported by the cylinder block 1 and the front housing member 2. A lug plate 11 is fixed to the drive shaft 6 in the crank chamber 5 to rotate integrally with the drive shaft 6.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The drive shaft 6 extends through the swash plate 12. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Cylinder bores 1*a* (only one is shown in FIG. 1) are formed at constant angular intervals around the drive shaft 6. Each cylinder bore 1*a* accommodates a single headed piston 20. Each cylinder bore 1*a* is closed by the valve plate assembly 3 and the associated piston 20, and a compression chamber, the volume of which varies in accordance with the reciprocation of the piston 20, is defined in the cylinder bore 1*a*. The front end of each piston 20 is connected to the periphery of the swash plate 12 through a pair of shoes 19. When the drive shaft 6 rotates, the swash plate 12 rotates integrally, and the rotation is converted into reciprocation of the pistons 20.

A suction chamber 21 and a discharge chamber 22 are defined between the valve plate assembly 3 and the rear housing member 4. The suction chamber 21 is located in the radial center of the rear housing member 4, and the discharge chamber 22 surrounds the suction chamber 21. The valve plate assembly 3 has suction ports 23 and discharge ports 25, which correspond to each cylinder bore 1*a*. The valve plate assembly 3 also has suction valve flaps 24, each of which corresponds to one of the suction ports 23, and discharge valve flaps 26, each of which corresponds to one of the discharge ports 25. The suction chamber 21 is connected to each cylinder bore 1*a* through the corresponding suction port 23, and the discharge chamber 22 is connected to each cylinder bore 1*a* through the corresponding discharge port 25.

When each piston 20 moves from the top dead center position to the bottom dead center position, refrigerant gas in the suction chamber 21 flows into the corresponding cylinder bore 1*a* through the corresponding suction port 23 while flexing the suction valve flap 24 to an open position. When each piston 20 moves from the bottom dead center position to the top dead center position, refrigerant gas in the corresponding cylinder bore 1*a* is compressed to a predetermined pressure and is discharged to the discharge chamber 22 through the corresponding discharge port 25 while flexing the discharge valve 26 to an open position.

The inclination angle of the swash plate 12 (the angle between the swash plate 12 and a plane perpendicular to the axis of the drive shaft 6) is determined on the basis of various moments such as the moment of rotation caused by the centrifugal force upon rotation of the swash plate, the moment of inertia based on the reciprocation of the pistons 20, and a moment due to the gas pressure. The moment due to the gas pressure is based on the relationship between the pressure in the cylinder bores 1*a* and the pressure in the crank chamber 5 (crank chamber pressure Pc). The moment due to the gas pressure increases or decreases the inclination angle of the swash plate 12 in accordance with the crank chamber pressure Pc.

In this embodiment, the moment due to the gas pressure is changed by controlling the crank chamber pressure Pc with a control valve CV, which will be discussed below. The inclination angle of the swash plate 12 can be changed to an arbitrary angle between the minimum inclination angle (shown by a solid line in FIG. 1) and the maximum inclination angle (shown by a broken line in FIG. 1).

The compressor includes a mechanism for controlling the crank chamber pressure Pc, which affects the inclination angle of the swash plate 12. The crank chamber pressure control mechanism includes a bleed passage 27, a supply passage 28, and the control valve CV, all of which are provided in the housing of the compressor shown in FIG. 1. The bleed passage 27 connects the crank chamber 5 with the suction chamber 21, which is a suction pressure zone. The supply passage 28, which functions as a pressure control passage, connects the crank chamber 5 with the discharge chamber 22, which is a discharge pressure zone. The control valve CV is located in the supply passage 28.

By controlling the degree of opening of the control valve CV, the relationship between the flow rate of high-pressure gas flowing into the crank chamber 5 through the supply passage 28 and the flow rate of gas flowing out of the crank chamber 5 through the bleed passage 27 is controlled to determine the crank chamber pressure Pc. In accordance with a change in the crank chamber pressure Pc, the difference between the crank chamber pressure Pc and the pressure in each cylinder bore 1*a* is changed to change the inclination angle of the swash plate 12. As a result, the stroke of each piston 20, that is, the discharge displacement, is controlled.

Figure 2:
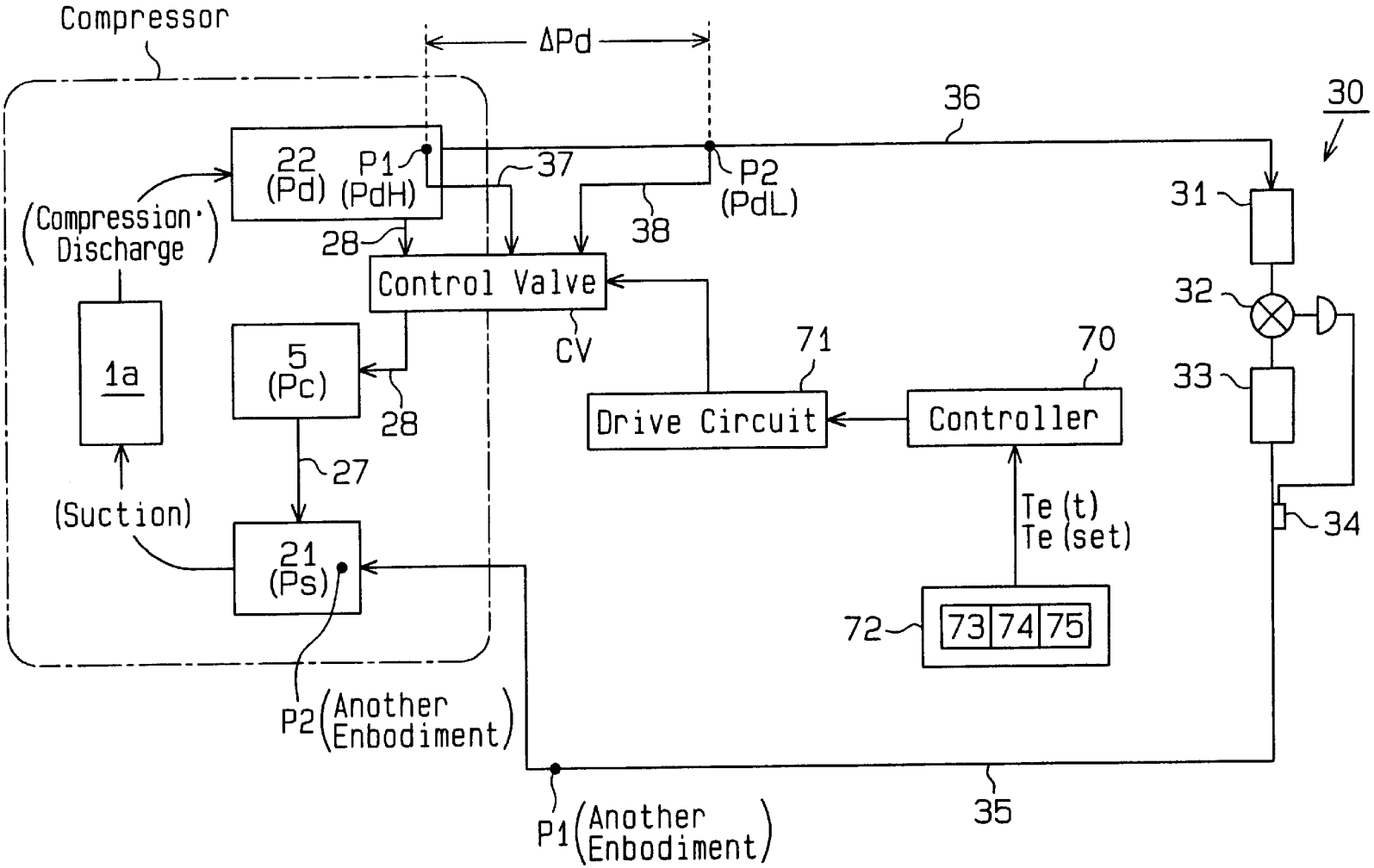
FIG. 2 is a schematic diagram illustrating a refrigeration circuit according to the embodiment of FIG. 1.

As shown in FIGS. 1 and 2, the refrigerant circuit of a vehicle air conditioner includes the variable displacement swash plate type compressor and an external refrigerant circuit 30. The external refrigerant circuit 30 includes, for example, a condenser 31, a decompression device and an evaporator 33. The decompression device is an expansion valve 32 in this embodiment. The opening of the expansion valve 32 is feedback-controlled based on the temperature detected by a heat sensitive tube 34 at the outlet of the evaporator 33 and the refrigerant pressure at the evaporator outlet. The expansion valve 32 supplies liquid refrigerant to the evaporator 33 to regulate the flow rate in the external refrigerant circuit 30. The amount of the supplied refrigerant corresponds to the thermal load.

A downstream pipe 35 is located in a downstream section of the refrigerant circuit 30 to connect the outlet of the evaporator 33 to the suction chamber 21 of the compressor. An upstream pipe 36 is located in an upstream section of the refrigerant circuit 30 to connect the discharge chamber 22 of the compressor to the inlet of the condenser 31. The compressor draws refrigerant gas from the downstream section of the refrigeration circuit 30 and compresses the gas. The compressor then discharges the compressed gas to the discharge chamber 22, which is connected to the upstream section of the circuit 30.

The greater the flow rate of the refrigerant is, the greater the pressure loss per unit length of the circuit is. That is, the pressure loss between two points in the refrigeration circuit corresponds to the flow rate of refrigerant in the circuit. That is, the pressure loss (pressure difference) between two pressure monitoring points P1, P2, which are located in the refrigerant circuit has a positive correlation with the flow rate of the refrigerant in the circuit. Detecting the difference ΔPd (ΔPd=PdH−PdL) between the pressure monitoring points P1, P2 permits the flow rate of refrigerant in the refrigerant circuit to be indirectly detected. When the pressure displacement increases, the flow rate of refrigerant in the circuit increases, and when the displacement decreases, the flow rate decreases. Thus, the flow rate of refrigerant, or the pressure difference ΔPd between the two points P1 and P2, represents the pressure displacement.

In this embodiment, the pressure monitoring points P1, P2 are defined in the upstream pipe 36. The first pressure monitoring point P1 is located in the discharge chamber 22, which is the most upstream section of the upstream pipe 36. The second pressure monitoring point P2 is located in the upstream pipe 36 and is spaced from the first point P1 by a predetermined distance. A part of the control valve CV is exposed to the pressure PdH at the first point P1 by a first pressure introduction passage 37. Another part of the control valve CV is exposed to a pressure PdL at the second point P2 by a second pressure introduction passage 38.

Figure 3:
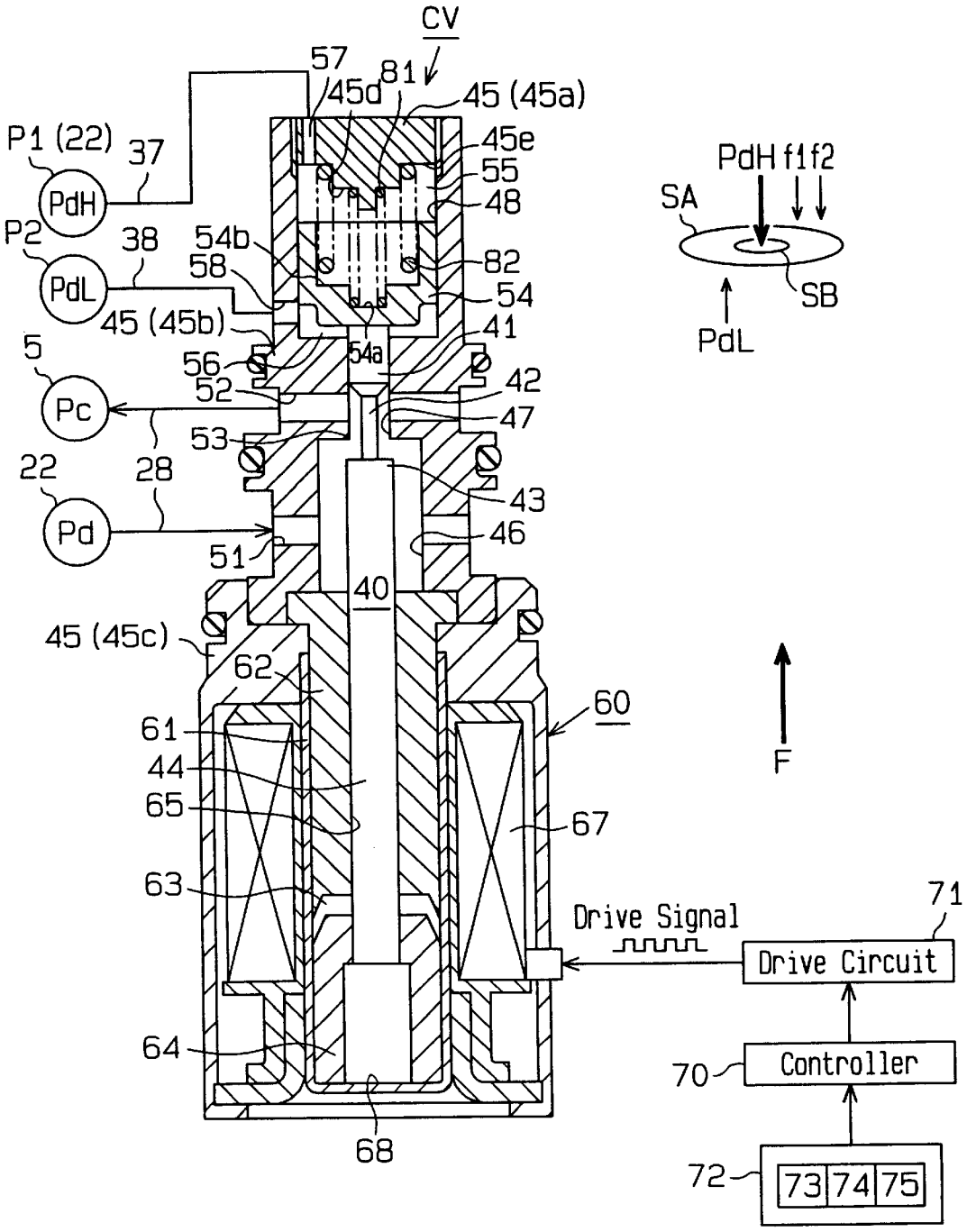
FIG. 3 is a cross-sectional view illustrating the control valve in the compressor of FIG. 1.

As shown in FIG. 3, the control valve CV includes an supply valve portion and a solenoid 60. The supply valve portion is arranged in an upper portion of the valve CV and the solenoid 60 is arranged in a lower portion of the valve CV. The supply valve portion adjusts the opening size (throttle amount) of the supply passage 28, which connects the discharge chamber 22 to the crank chamber 5. The solenoid 60 is an electromagnetic actuator for urging an operation rod 40 located in the control valve CV based on current supplied from an outside source. The rod 40 has a partition 41, a coupler 42, a valve body 43 and a guide portion 44. The partition 41 is formed at the distal end of the rod 40. The guide portion 44 is formed at the proximal end. The valve body 43 is a part of the guide portion 44.

A valve housing 45 of the control valve CV includes a plug 45*a*, an upper portion 45*b*, which forms the general outline of the supply valve portion, and a lower portion 45*c*, which forms a general outline of the solenoid 60. A valve chamber 46 and a communication passage 47 are formed in the upper portion 45*b*. The plug 45*a* is screwed into the upper portion 45*b*. A pressure-sensing chamber 48 is defined between the plug 45*a* and the upper portion 45*b*.

The rod 40 extends through the valve chamber 46 and the communication passage 47 and moves axially, or in the vertical direction as viewed in the drawing. The valve chamber 46 is selectively connected to the communication passage 47 depending on the position of the rod 40. The communication passage 47 is disconnected from the pressure-sensing chamber 48 by the partition 41 of the rod 40, which extends through the communication passage 47.

The bottom of the valve chamber 46 is formed by the upper surface of a fixed iron core 62. A Pd port 51 extends radially from the valve chamber 46. The valve chamber 46 is connected to the discharge chamber 22 through the Pd port 51 and the upstream section of the supply passage 28. A Pc port 52 is formed in the wall of the valve housing 45 and radially extends from the communication passage 47. The communication passage 47 is connected to the crank chamber 5 through the downstream section of the supply passage 28 and the Pc port 52. Therefore, the Pd port 51, the valve chamber 46, the communication passage 47 and the Pc port 52 are formed in the control valve CV and form a part of the supply passage 28.

The valve body 43 of the rod 40 is located in the valve chamber 46. The diameter of the communication passage 47 is greater than the diameter of the coupler 42 and smaller than the diameter of the guide portion 44. That is, the cross-sectional area SB of the communication passage 47, or the cross-sectional area of the partition 41, is greater than the cross-sectional area of the coupler 42 and smaller than the cross-sectional area of the guide portion 44. Thus, a step is formed between the valve chamber 46 and the communication passage 47. The step functions as a valve seat 53, and the communication passage 47 functions as a valve hole.

Figures 4A, 4B, 4C:
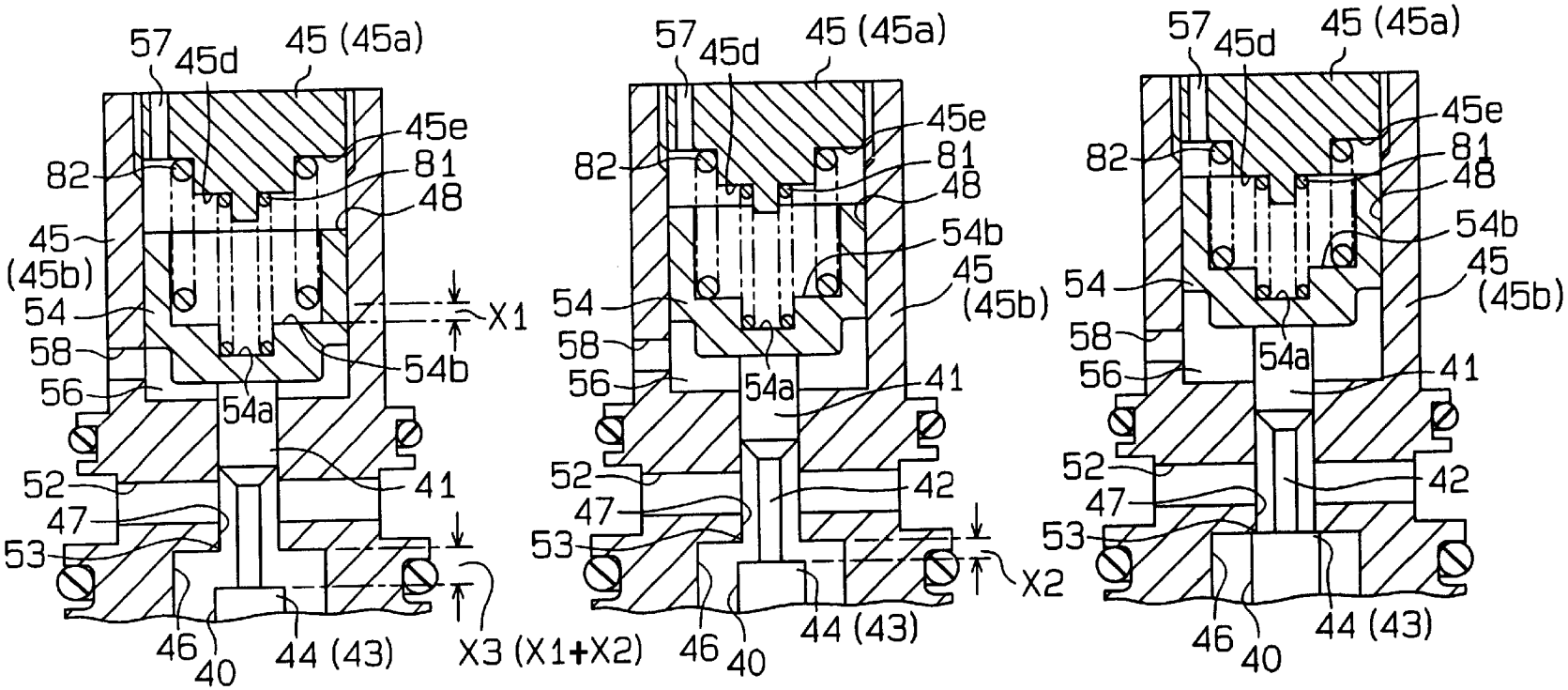
FIGS. 4(*a*), 4(*b*) and 4(*c*) are enlarged cross-sectional views showing the operation of the control valve shown in FIG. 3.

When the rod 40 has moved from the position shown in FIGS. 3 and 4(*a*) (the lowest position) to the position shown in FIG. 4(*c*) (the uppermost position), at which the valve body 43 contacts the valve seat 53, the communication passage 47 is closed. The valve body 43 serves as an supply valve body that arbitrarily controls the degree of opening of the supply passage 28.

A cup-shaped pressure-sensing member 54 is located in the pressure-sensing chamber 48. The pressure-sensing member 54 moves in the axial direction and divides the pressure-sensing chamber 48 into a first pressure chamber 55 and a second pressure chamber 56. The pressure-sensing member 54 does not permit fluid to move between the first pressure chamber 55 and the second pressure chamber 56. The cross-sectional area SA of the pressure-sensing member 54 is greater than the cross-sectional area SB of the communication passage 47.

The first pressure chamber 55 accommodates a first coil spring 81 and a second coil spring 82, the diameter of which is greater than that of the first spring 81. The first spring 81 extends between a spring seat 54*a*, which is formed on the bottom of the pressure-sensing member 54, and a spring seat 45*d*, which is formed on the lower surface of the plug 45*a*. Therefore, the first spring 81 urges the pressure-sensing member 54 from the first pressure chamber 55 to the second pressure chamber 56. The spring seats 54*a*, 45*d* form a first set of spring seats for receiving the first spring 81.

The second spring 82 is coaxial with and located about the first spring 81. The second spring 82 extends between a spring seat 54*b*, which is formed on the bottom of the pressure-sensing member 54, and a spring seat 45*e*, which is formed on the lower surface of the plug 45*a*. Therefore, like the first spring 81, the second spring 82 urges the pressure-sensing member 54 from the first pressure chamber 55 to the second pressure chamber 56. The spring seats 54*b*, 45*e* form a second set of spring seats for receiving the second spring 82. The maximum distance between the spring seats 45*d* and 54*a* in the first set and the maximum distance between the spring seats 45*e* and 54*b* in the second set can be adjusted by changing the threaded amount of the plug 45*a* to the upper portion 45*b*, or the axial position of the plug 45*a*.

The upper end of the partition 41 of the rod 40 protrudes into the pressure-sensing chamber 48 (the second pressure chamber 56). The pressure-sensing member 54 is pressed against the upper end face of the partition 41 by the force f1 of the first spring 81 and the force f2 of the second spring 82. Therefore, the pressure-sensing member 54 and the rod 40 move integrally.

The first pressure chamber 55 is connected to the discharge chamber 22, in which the first pressure monitoring point P1 is provided, by a first port 57 formed in the plug 45*a* and the first pressure introduction passage 37. A second port 58 is formed in the upper portion 45*b*. The second pressure chamber 56 is connected to the second pressure monitoring point P2, which is provided in the upstream pipe 36, by the second port 58 and the second pressure introduction passage 38. That is, the first pressure chamber 55 is exposed to a pressure PdH, which is the discharge pressure Pd at the first pressure monitoring point P1 in the discharge chamber 22. The second pressure chamber 56 is exposed to a pressure PdL, which is the pressure at the second pressure monitoring point P2 in the upstream pipe 36.

The solenoid 60 includes a cup-shaped cylinder 61. The fixed iron core 62 is fitted into an upper opening of the cylinder 61. The fixed iron core 62 defines a solenoid chamber 63 in the cylinder 61. A movable iron core 64 is located in the solenoid chamber 63. The movable iron core 64 is moved axially. The fixed iron core 62 has a guide hole 65 through which the guide portion 44 extends.

The proximal portion of the rod 40 is located in the solenoid chamber 63. The lower end of the guide portion 44 is fitted into a hole formed in the center of the movable iron core 64. The movable iron core 64 is crimped to the guide portion 44. Thus, the movable core 64 moves integrally with the rod 40.

A further downward movement of the rod 40, or a displacement of the valve body 43 to further increase the opening of the communication passage 47, is limited by contact between the lower face of the movable core 64 and the bottom of the solenoid chamber 63. When the downward movement of the rod 40 is limited, the pressure-sensing member 54, which moves integrally with the rod 40, is also prevented from moving downward. The bottom of the solenoid chamber 63 functions as a stopper 68, which limits the downward movement of the valve body 43 and the pressure-sensing member 54.

When the iron core 64 contacts the stopper 68 as shown in FIGS. 3 and 4(*a*), the rod 40 is at the lowest position (fully open position). In this state, the valve body 43 is away from the valve seat 53 by a distance X3 and the opening of the communication passage 47 is maximized. Also, the distance between the first spring seat 54*a* of the pressure-sensing member 54 and the first spring seat 45*d* of the plug 45*a* is maximized. The normal length, or the length when no load is applied, of the first spring 81 is greater than the maximum distance between the first spring seats 45*d* and 54*a*. Therefore, the force f1 of the first spring 81 is constantly applied to the pressure-sensing member 54 through the entire range of the opening degree of the communication passage 47, or from a position at which the valve body 43 fully opens the communication passage 47 as shown in FIG. 4(*a*) to a position at which the valve body 43 contacts the valve seat 53 to fully close the communication passage 47 as shown in FIG. 4(*c*).

When the valve body 43 is away from the valve seat 53 by the distance X3 as shown in FIG. 4(*a*), the distance between the second spring seat 54*b* of the pressure-sensing member 54 and the second spring seat 45*e* of the plug 45*a* is also maximized. However, the normal length of the second spring 82 is smaller than the maximum distance between the second spring seats 45*e* and 54*b* by a distance X1. Therefore, the second spring 82 does not apply its force f2 to the pressure-sensing member 54 unless the pressure-sensing member 54 moves upward from the lowest position by a distance that is equal to or greater than the distance X1. When the pressure-sensing member 54 moves upward from the lowest position shown in FIG. 4(*a*) by the distance X1 as shown in FIG. 4(*b*), the distance between the valve body 43 and the valve seat 53 is an intermediate distance X2. Thus, the maximum distance X3 between the valve body 43 and the valve seat 53 is equal to the sum of the distances X1 and X2 (X1+X2).

Accordingly, when the distance between the valve body 43 and the valve seat 53 is between the maximum distance X3 shown in FIG. 4(*a*) and the intermediate distance X2 shown in FIG. 4(*b*), only the force f1 of the first spring 81 is applied to the pressure-sensing member 54. When the distance is between the intermediate distance X2 and zero, which is shown in FIG. 4(*c*), the forces f1 and f2 of both of the first spring 81 and the second spring 82 are applied to the pressure-sensing member 54.

As shown in FIG. 3, a coil 67 is wound about the fixed core 62 and the movable core 64. The coil 67 receives drive signals from a drive circuit 71 based on commands from a controller 70. The coil 67 generates an electromagnetic force F that corresponds to the value of the current from the drive circuit 71. The electric current supplied to the coil 67 is controlled by controlling the voltage applied to the coil 67. In this embodiment, for the control of the applied voltage, a duty control is employed.

In the control valve CV, the axial position of the rod 40, or the opening of the communication passage 47 by the valve body 43, is determined in the following manner. The effect of the pressure in the valve chamber 46, the pressure in communication passage 47, and the pressure in the solenoid chamber 63 on positioning of the rod 40 will not be considered in the description.

When no current is supplied to the coil 67 as shown in FIGS. 3 and 4(*a*), or when the duty ratio Dt of the voltage applied to the coil 67 is zero percent, the downward force f1 of the first spring 81 dominantly acts on the pressure-sensing member 54, which positions the rod 40 at the lowest position (fully open position). The rod 40 is pressed against the stopper 68 through the movable core 64 by the force f1 of the first spring f1. In this state, the force f1 of the first spring 81 integrally presses the rod 40, the pressure-sensing member 54 and the movable core 64 against the stopper 68 so that the rod 40, the pressure-sensing member 54 and the movable core 64 are not vibrated in the control valve CV when the compressor vibrates due to vibrations of the vehicle. In other words, the first spring 81 is designed and formed to generate the force f1, which integrally presses the rod 40, the pressure-sensing member 54 and the movable core 64 against the stopper 68, and holds movable members 40, 54, 64 against vibration when no current is supplied to the coil 67. The force f1 of the first spring 81 when no current is supplied to the coil 67 will be referred to positioning load f1'.

In the state of FIGS. 3 and 4(*a*), the valve body 43 of the rod 40 is away from the valve seat 53 by the distance X3 (X3=X1+X2), which fully opens the communication passage 47 (the supply passage 28). Therefore, the crank chamber pressure Pc is increased. Accordingly, the inclination of the swash plate 12 is minimized and the compressor displacement is minimized.

When the coil 67 is supplied with an electric current having the minimum duty ratio Dt(min), which is greater than zero, within the variation range of the duty ratio Dt, the upward electromagnetic force F becomes greater than the downward force f1, or the positioning load f1', of the first spring 81, so that the rod 40 starts moving upward.

Figure 5:
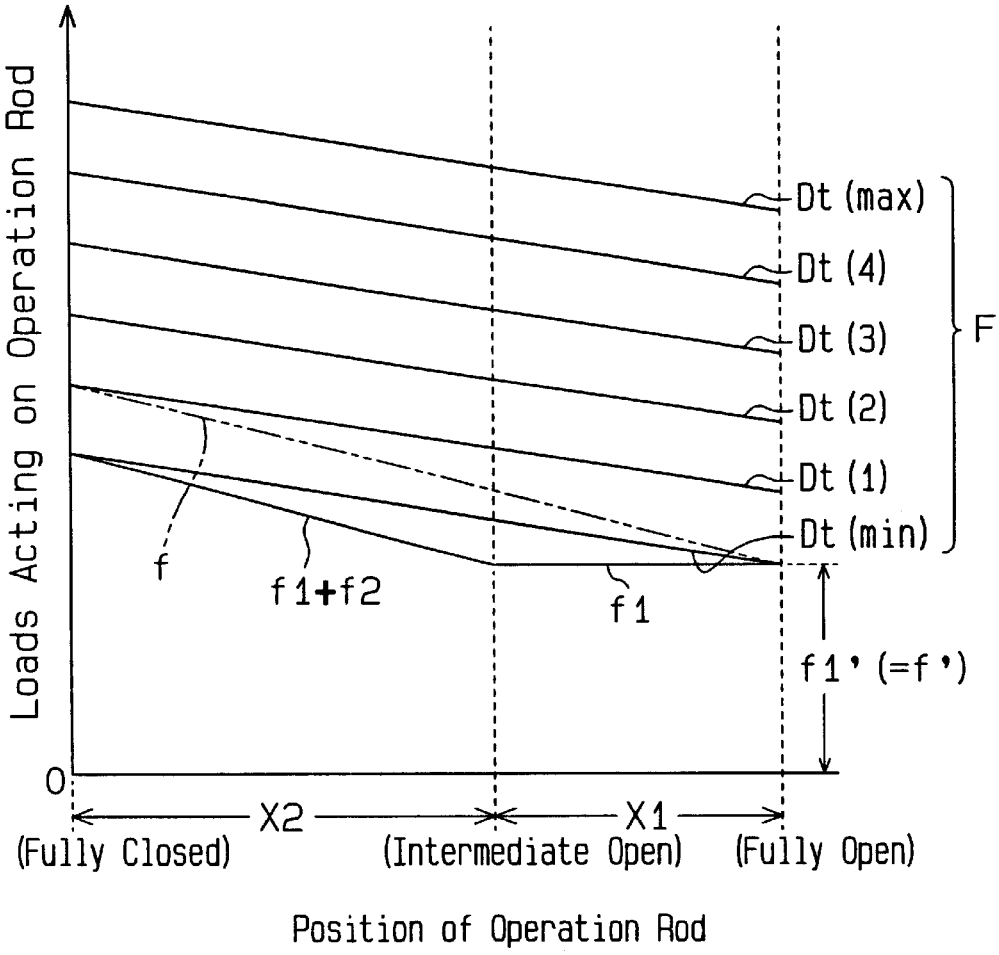
FIG. 5 is a graph showing the relationship between the loads acting on the operation rod and the position of the rod.

The graph of FIG. 5 shows the relationship between the axial position of the rod 40 (the valve body 43) and the loads acting on the rod 40. As shown in the graph, when the duty ratio Dt to the coil 67 is increased, the electromagnetic force F acting on the rod 40 is increased. Also, even if the duty ratio to the coil 67 is constant, the electromagnetic force F acting on the rod 40 is increased as the movable core 64 approaches the fixed core 62. In other words, as shown in the graph of FIG. 5, when the duty ratio Dt to the coil 67 is not changed, the electromagnetic force F acting on the rod 40 is increased as the rod 40 moves upward to decrease the opening of the communication passage 47.

The duty ratio Dt of the voltage applied to the coil 67 is continuously variable between the minimum duty ratio Dt(min) and the maximum duty ration Dt(max) (e.g., 100%) within the range of duty ratios. For ease of understanding, the graph of FIG. 5 only shows cases of Dt(min), Dt(1) to Dt(4), and Dt(max).

As apparent from the changes of the resultant f1+f2 of the force f1 of the first spring 81 and the force f2 of the second spring 82, and the changes of the force f1 of the first spring 81, the spring constant of the first spring 81 is significantly smaller than that of the second spring 82. Since the spring constant of the first spring 81 is small, the force f1, which is applied to the pressure-sensing member 54 by the first spring 81, is scarcely changed even if the distance between the first spring seats 45*d,* 54*a,* or the degree to which the first spring 81 is compressed, is changed. In other words, the force f1 of the first spring 81 is substantially maintained to the positioning load f1' regardless of the distance between the first spring seats 45*d,* 54*a.*

Therefore, as shown in FIGS. 4(*b*) and 4(*c*), when a voltage having the minimum duty ratio Dt(min) or a duty ratio that is greater than the minimum duty ratio Dt(min) is applied to the coil 67, the rod 40, the pressure-sensing member 54 and the movable core 64 are moved upward from the lowest position at least by the distance X1, which decreases the valve opening. Accordingly, the second spring 82 is compressed between the second spring seats 45*e,* 54*b.* Therefore, when the distance between the valve body 43 and the valve seat 53 is between the distance X2 and zero, both springs 81, 82 affect the position of the rod 40. That is, the upward electromagnetic force F acts against the resultant of the downward forces f1, f2 of the first and second springs 81, 82 and the downward force based on the pressure difference ΔPd between the two points P1, P2. Thus, when a voltage is applied to the coil 67, the axial position of the rod 40 satisfies the following equation (1) and is between the intermediate position shown in FIG. 4(*b*) and the highest position (fully closed position) shown in FIG. 4(*c*). In the equation (1), α represents PdL×SB. The pressure PdL at the second pressure monitoring point P2 is lower than the pressure PdH at the first pressure monitoring point P1, and the cross-sectional area SB is smaller than the cross-sectional area SA. Thus, the range of PdL×SB is narrow. Therefore, in the equation (1), PdL×SB is replaced by a predetermined constant value α.

$$PdH \cdot SA - PdL(SA-SB) = F - f1 - f2 \quad (1)$$

$$\downarrow$$

$$\Delta Pd = PdH - PdL = (F - f1 - f2 + \alpha)/SA$$

In other words, when a voltage is applied to the coil 67, the opening of the control valve CV is between the intermediate opening shown in FIG. 4(*b*) and the minimum opening (fully closed) shown in FIG. 4(*c*) and satisfies the equation (1). When the control valve CV at the intermediate opening state, the compressor displacement is minimized. When the control valve CV is fully closed, the compressor displacement is maximized.

For example, if the flow rate of the refrigerant in the refrigerant circuit is decreased due to a decrease in the rotational speed of the engine E, the downward force based on the pressure difference ΔPd between the two points P1 P2 decreases, and the electromagnetic force F, at this time, cannot balance the forces acting on the rod 40. Therefore, the rod 40 moves upward so that the second spring 82 is contracted and increases its force. At this time, as described above, the force f1 of the first spring 81 is maintained at the positioning load f1' and is scarcely changed. The valve body 43 of the rod 40 is positioned such that the increase in the downward force f2 of the second spring 82 compensates for the decrease in the pressure difference ΔPd between the two points P1, P2. As a result, the opening of the communication passage 47 is reduced and the crank chamber pressure Pc is lowered. Therefore, the inclination angle of the swash plate 12 is increased, and the displacement of the compressor is increased. The increase in the displacement of the compressor increases the flow rate of the refrigerant in the refrigerant circuit, which increases the pressure difference ΔPd between the two points P1, P2.

In contrast, when the flow rate of the refrigerant in the refrigerant circuit is increased due to an increase in the rotational speed of the engine E, the pressure difference ΔPd between the two points P1, P2 increases and the electromagnetic force F, at this time, cannot balance the forces acting on the rod 40. Therefore, the rod 40 moves downward, which expands the second spring 82 and decreases the force of the second spring 82. The valve body 43 of the rod 40 is positioned such that the decrease in the downward force f2 of the second spring 82 compensates for the increase in the pressure difference ΔPd between the two points P1, P2. As a result, the opening of the communication passage 47 is increased, the crank chamber pressure Pc is increased. Therefore, the inclination angle of the swash plate 12 is decreased, and the displacement of the compressor is also decreased. The decrease in the displacement of the compressor decreases the flow rate of the refrigerant in the refrigerant circuit, which decreases the pressure difference ΔPd between the two points P1, P2.

When the duty ratio Dt of the electric current supplied to the coil 67 is increased to increase the electromagnetic force F, the pressure difference ΔPd between the two points P1, P2 cannot balance the forces on the rod 40. Therefore, the rod 40 moves upward so that the second spring 82 is contracted and increases its force. The position of the valve body 43 of the rod 40 is determined such that the increase in the downward force f2 of the second spring 82 balances with the increase in the upward electromagnetic force F. Therefore, the opening of the control valve CV, or the opening of the communication passage 47, is reduced and the displacement of the compressor is increased. As a result, the flow rate of the refrigerant in the refrigerant circuit is increased to increase the pressure difference ΔPd between the two points P1, P2.

If the duty ratio Dt of the voltage applied to the coil 67 is lowered to decrease the electromagnetic force F, the pressure difference ΔPd cannot balance the upward and downward forces, and the rod 40 is moved downward. Accordingly, the force of the second spring 82 is decreased. The position of the valve body 43 is determined such that the decreased downward force f2 of the second spring 82 balances with the decreased upward electromagnetic force F. Therefore, the opening size of the communication passage 47 is increased and the compressor displacement is decreased. As a result, the flow rate in the refrigerant circuit and the pressure difference ΔPd between the two points P1, P2 are decreased.

As described above, when a voltage having a duty ratio that is equal to or greater than the minimum duty ratio Dt(min) is applied to the coil 67, the control valve CV determines the position of the rod 40 in accordance with the pressure difference ΔPd between the two points p1, P2 such that the target value of the pressure difference ΔPd between the two points P1, P2 (target pressure difference), which is determined by the electromagnetic force F, is maintained. The target pressure difference is varied between a minimum value that corresponds to the minimum duty ratio Dt(min) and a maximum value that corresponds to the maximum duty ratio Dt(max).

As shown in FIGS. 2 and 3, the vehicle air conditioner includes the controller 70, which controls the air conditioner. The controller 70 includes a CPU, a ROM, a RAM and an I/O interface. The output terminal of the I/O interface is connected to the drive circuit 71. The input terminal of the I/O interface is connected to a group 72 of external information detection devices.

The controller 70 computes an appropriate duty ratio Dt based on various external information provided from the detection device group 72 and commands the drive circuit 71 to output a driving signal having the computed duty ratio Dt. The drive circuit 71 outputs the instructed driving signal having the duty ratio Dt to the coil 67. In accordance with the duty ratio Dt of the driving signal provided to the coil 67, the electromagnetic force F of the solenoid 60 of the control valve CV is changed.

The detection device group 72 includes, for example, an A/C switch 73 (ON/OFF switch of the air conditioner operated by a passenger), a temperature sensor 74 for detecting the temperature Te (t) in the vehicle passenger compartment, a temperature adjuster 75 for setting a target temperature Te (set) in the passenger compartment.

Figure 6:
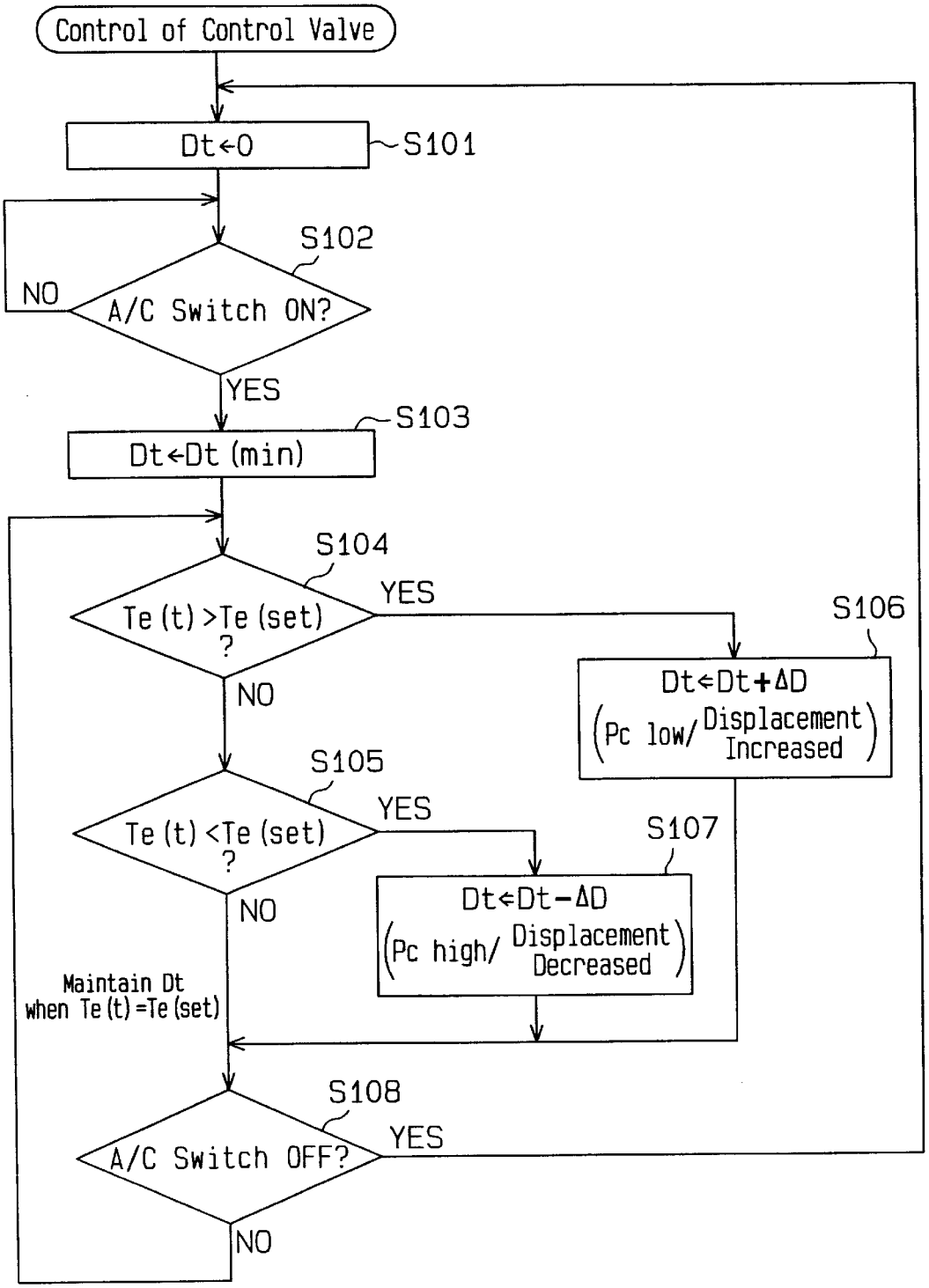
FIG. 6 is a flowchart showing a routine for controlling the control valve shown in FIG. 3.

The duty control of the control valve CV by a controller 70 will now be described with reference to the flowchart of FIG. 6.

When the vehicle ignition switch (or starting switch) is turned on, the controller 70 receives power and starts processing. The controller 70 performs various initial setting in accordance with the initial program in step S101. For example, the initial value of the duty ratio Dt of the voltage applied to the control valve CV is set zero.

In step S102, until the A/C switch 73 is turned ON, the ON/OFF condition of the switch is monitored. When the A/C switch 73 is turned on, the controller 70 moves to step S103. In step S103, the controller 70 sets the duty ratio Dt to the control valve CV to the minimum duty ratio Dt(min) to cause the control valve CV to start operating. Accordingly, the control valve CV operates to maintain a target pressure difference.

In step S104, the controller 70 judges whether the temperature Te(t) is higher than the target temperature Te(set), which is set by the temperature adjuster 75. If the outcome of step S104 is negative, the controller 70 moves to step S105. In step S104, the controller 70 judges whether the temperature Te(t) is lower than the target temperature Te(set). If the outcome of step S105 is also negative, the detected temperature Te(t) is equal to the target temperature Te(set). Therefore, the cooling performance is not changed. Specifically, the duty ratio Dt is not changed. Thus, the controller 70 proceeds to step S108 without commanding the drive circuit 71 to change the duty ratio Dt.

If the outcome of step S104 is positive, the passenger compartment temperature is judged to be high and the cooling load is judged to be great. Therefore, the controller 70 increases the duty ratio Dt by an amount ΔD in step S106 and commands the drive circuit 71 to set the duty ratio to the increased duty ratio (Dt+ΔD). Accordingly, the opening of the control valve CV is decreased and the compressor displacement is increased. When the discharge displacement of the compressor is increased, the cooling performance of the evaporator 33 is also increased, which lowers the passenger compartment temperature Te(t).

If the outcome of step S105 is positive, the compartment temperature is judged to be low and the thermal load is judged to be small. In this case, the controller 70 moves to step S107 and reduces the duty ratio Dt by the amount ΔD. The controller 70 commands the drive circuit 71 to decrease the duty ratio Dt to (Dt−ΔD). This increases the opening of the control valve CV and decreases the compressor displacement. Accordingly, the cooling performance of the evaporator 33 is lowered and the temperature Te(t) increases.

In step S108, the controller 70 judges whether the A/C switch is turned off. If the outcome of step S108 is negative, the controller 70 proceeds to step S104 and repeats the procedure from step S104. If the outcome of step S108 is positive, the controller 70 proceeds to step S101 and stops current to the control valve CV. Accordingly, the opening of the control valve CV is maximized. That is, the supply passage 28 is maximally opened and the crank chamber pressure Pc is increased as quickly as possible. As a result, as the A/C switch 73 is turned off, the compressor displacement is quickly minimized. Thus, when the A/C switch 73 is turned off, the flow of refrigerant in the refrigerant circuit is quickly stopped, which stops cooling operation.

Since the power transmission mechanism PT has no clutch, the compressor is continuously operated while the engine E is running. Thus, when refrigeration is not needed, or when the A/C switch 73 is off, the compressor displacement must be minimized to reduce the power loss of the engine E. In this embodiment, the control valve CV is fully opened as shown in FIG. 4(*a*) when the A/C switch 73 is turned off. In the full open state, the control valve CV increases the flow rate of refrigerant through the supply passage 28 than the intermediate opening shown in FIG. 4(*b*), at which the compressor displacement can be minimized. Thus, when the A/C switch 73 is turned off, the compressor displacement is quickly and reliably minimized.

As described above, the control valve CV operates such that the detected temperature Te(t) seeks the target temperature Te(set) through step S106 and/or step S107, in which the duty ratio Dt is changed.

The embodiment of FIGS. 1 to 6 has the following advantages.

(1) The suction pressure Ps is greatly influenced by changes in the thermal load on the evaporator 33. In the embodiment of FIGS. 1–6, the suction pressure Ps is not directly referred to for controlling the opening size of the displacement control valve CV. Instead, the pressure difference ΔPd between the two pressure monitoring points P1 and P2 is directly controlled for feedback controlling the compressor displacement. Therefore, the compressor displacement is quickly and accurately controlled from the outside without being influenced by the thermal load on the evaporator 33.

(2) The control valve CV includes the two springs 81, 82 for urging the pressure-sensing member 54. The springs 81, 82 are accommodated in the pressure-sensing chamber 48. This structure allows the characteristics such as the spring constant of the springs 81, 82 to be independently determined, and adds to the flexibility of the design in the operational characteristics of the control valve CV.

(3) When no voltage is applied to the coil 67, the first spring 81 presses the rod 40, the pressure-sensing member 54 and the movable core 64 against the bottom of the solenoid chamber 63, which functions as the stopper 68, so that the members 40, 54, 64 do not vibrate. Therefore, when the vehicle vibrates, the movable members 40, 54, 64 are not vibrated in the control valve CV. Thus, the movable members 40, 54, 64 do not collide with the stationary members such as the valve housing 45.

(4) A control valve that includes a single spring for urging the pressure-sensing member 54 in the pressure-sensing chamber 48 will now be discussed as a comparison example. The comparison example control valve is the same as the control valve CV of the illustrated embodiment except that the example control valve does not have the second spring 82. Broken line in the graph of FIG. 5 represents relationship between the force of the spring in the example valve and the axial position of the rod 40. The axial position of the rod 40 in the example control valve CV satisfies the following equation (2). In the equation (2), β represents PdL×SB. As in the case of the value α in the equation (1), the range of PdL×SB is narrow. Therefore, in the equation (2), PdL×SB is replaced by a predetermined constant value β.

$$PdH \cdot SA - PdL(SA-SB) = F - f \quad (2)$$

$$\downarrow$$

$$\Delta Pd = PdH - PdL = (F - f + \beta)/SA$$

As shown by broken line in FIG. 5, when no voltage is applied to the coil 67 (when the rod 40 is at the fully open position), the spring of the example valve must generate a positioning load f', like the first spring 81 of the control valve CV according to the illustrated embodiment, so that the movable members 40, 54, 64 are pressed against the stopper 68 and do not vibrate. The positioning load f' of the comparison example is equal to the positioning load f' of the first spring 81 of the illustrated embodiment.

As described above, the first spring 81 of the illustrated embodiment constantly generates the force f1 regardless of its contraction degree. Thus, the characteristics of the resultant f1+f2 of FIG. 5 substantially represents the operation characteristics of the force f2 of the second spring 82. To match the operation characteristics of the rod 40 of the comparison example valve with those of the rod 40 of the illustrated embodiment in a range between the fully closed position and the intermediate position, the characteristics of the force f of the comparison spring must be equal to those of the force f2 of the second spring 82 in the illustrated embodiment as shown in graph of FIG. 5.

Also, the equation (2) indicates that the spring constant of the comparison example spring must be determined such that a change of the force f of the comparison example spring in accordance with the axial position of the rod 40 is greater than a change of the electromagnetic force F in accordance with the axial position of the rod 40. This is also true for the second spring 82 of the illustrated embodiment.

As a result, unlike the control valve CV of the illustrated embodiment, the force f of the spring in the comparison example control valve gradually increases from the positioning load f' as the rod 40 is moved from the fully open position to the intermediate position. Therefore, to move the rod 40 from the fully open position to the intermediate position, the duty ratio Dt of the voltage applied to the coil 67 must be increased to a value that is greater than the minimum value Dt(min), which is shown in FIG. 5. For example, the duty ratio Dt must be increased to a value Dt(1).

In the control valve CV of the illustrated embodiment, when a voltage is applied to the coil 67, the rod 40 is moved between the intermediate position and the fully closed position in accordance with the pressure difference ΔPd between the two points P1, P2, which controls the compressor displacement between the minimum displacement and the maximum displacement. The fully open position of the rod 40 is position for quickly and reliably minimizing the compressor displacement. When the rod 40 is between the fully open position and the intermediate position, the compressor displacement is always minimum. That is, the range of the movement of the rod 40 between the fully open position and the intermediate position is not used for controlling the compressor displacement. Therefore, to control the compressor displacement with the control valve CV, the rod 40 must be moved upward at least to the intermediate position. At this time, if the duty ratio Dt of the voltage applied to the coil 67 is set to the minimum value Dt(min), which is shown in FIG. 5, in the illustrated embodiment, the rod 40 is moved upward to the intermediate position. Therefore, the pressure difference ΔPd between the two points P1, P2 can be changed between a minimum value that corresponds to the minimum duty ratio Dt(min) and a maximum value that corresponds to the maximum duty ratio Dt(max).

In the comparison example control valve, the duty ratio Dt of the voltage applied to the coil 67 must be set, for example, at the value Dt(1), which is greater than the minimum value Dt(min), to move the rod 40 to the intermediate position by the electromagnetic force F. Therefore, the pressure difference ΔPd between the two points P1, P2 is changed between a minimum value that corresponds to the value Dt(1) and a maximum value that corresponds to the maximum duty ratio Dt(max). This means that the range of the pressure difference ΔPd is narrower than that of the illustrated embodiment.

Further, in the comparison example control valve, the force f of the spring is greater than the resultant force f1+f2 of the springs 81, 82 of the illustrated embodiment regardless of the axial position of the rod 40 as shown in FIG. 5. Thus, when the duty ratio Dt is the maximum value Dt(max), a value of the pressure difference ΔPd that satisfies the equation (2) is smaller than a value of the pressure difference ΔPd that satisfies the equation (1). This means that the maximum target value of the pressure difference ΔPd, or the maximum value of the controllable flow rate of the refrigerant in the refrigerant circuit, is smaller than that of the illustrated embodiment.

If the cross-sectional area SA of the pressure-sensing member 54 is decreased in the comparison example control valve, the right side of the equation (2) is increased. Thus, the maximum target value of the pressure difference ΔPd is increased. At the same time, however, the minimum target value of the pressure difference ΔPd is increased. As a result, the minimum value of the controllable flow rate in the refrigerant circuit is increased.

The control valve CV of the illustrated embodiment has the two springs 81, 82, which urge the pressure-sensing member 54. The first spring 81 can hold the rod 40 at the fully open position. Also, the spring constant of the first spring 81 is a relatively small so that the spring 81 generates the force f1, which is substantially unchanged in the entire movement range of the rod 40. The spring constant of the second spring 82 is relatively great so that the position of the rod 40 is accurately determined between the intermediate position and the fully closed position.

As a result, in the illustrated embodiment, the movable members 40, 54, 64 are reliably prevented from being vibrated. Also, the target value of the pressure difference ΔPd (target pressure difference) can be changed in a wide range. Since the target pressure difference is changed in the wide range, the flow rate in the refrigerant circuit can be controlled in a wide range.

(5) A compressor for a vehicle air conditioner is generally accommodated in small engine compartment, which limits the size of the compressor. Therefore, the size of the control valve CV and the size of the solenoid 60 (coil 67) are limited. Also, the solenoid 60 is generally driven by a battery that is used for controlling the engine. The voltage of the battery is, for example, twelve or twenty-four volts.

In the comparative example valve, the range of variation of the target pressure difference could be widened by increasing the maximum electromagnetic force F that the solenoid 60 is capable of generating. Increasing the maximum electromagnetic force F would require the size of the coil 67 and the voltage of the power source be increased and therefore would entail considerable changes in existing systems and structures. Thus, practically, the maximum electromagnetic force F cannot be increased. However, the control valve CV of the illustrated embodiment, which includes the two springs 81, 82 to urge the pressure-sensing member 54, can widen the range of the target pressure difference without increasing the size of the coil 67 or the voltage of the power source.

(6) The first spring 81 urges the pressure-sensing member 54 from the first pressure chamber 55 to the second pressure chamber 56. Likewise, the force based on the pressure difference between the first pressure chamber 55 and the second pressure chamber 56, or the force based on the pressure difference ΔPd between the two points P1, P2, urges the pressure-sensing member 54 from the first pressure chamber 55 toward the second pressure chamber 56. Therefore, when no current is supplied to the coil 67, not only the force of the first spring 81, but also, the force based on the pressure difference ΔPd between the two points press the pressure-sensing member 54 against the stopper 68.

(7) The control valve CV changes the pressure in the crank chamber 5 by changing the opening of the supply passage 28. Compared to a case where the crank chamber pressure Pc is changed by changing the opening of the bleed passage 27, the control valve CV uses higher pressures. Therefore, the control valve CV quickly changes the pressure in the crank chamber 5, or the displacement, which improves the cooling performance.

(8) The first pressure monitoring point P1 is located in the discharge chamber 22 of the compressor, and the second pressure monitoring point P2 is located in the upstream pipe 36, which is upstream of the evaporator 31. Therefore, the operation of the expansion valve 32 does not affect pressure difference ΔPd between the two points P1, P2, and the compressor displacement is reliably controlled in accordance with the pressure difference ΔPd.

It should be apparent to those skilled in the art that the present invention may be embodied in many other specific forms without departing from the spirit or scope of the invention. Particularly, it should be understood that the invention may be embodied in the following forms.

Figure 7:
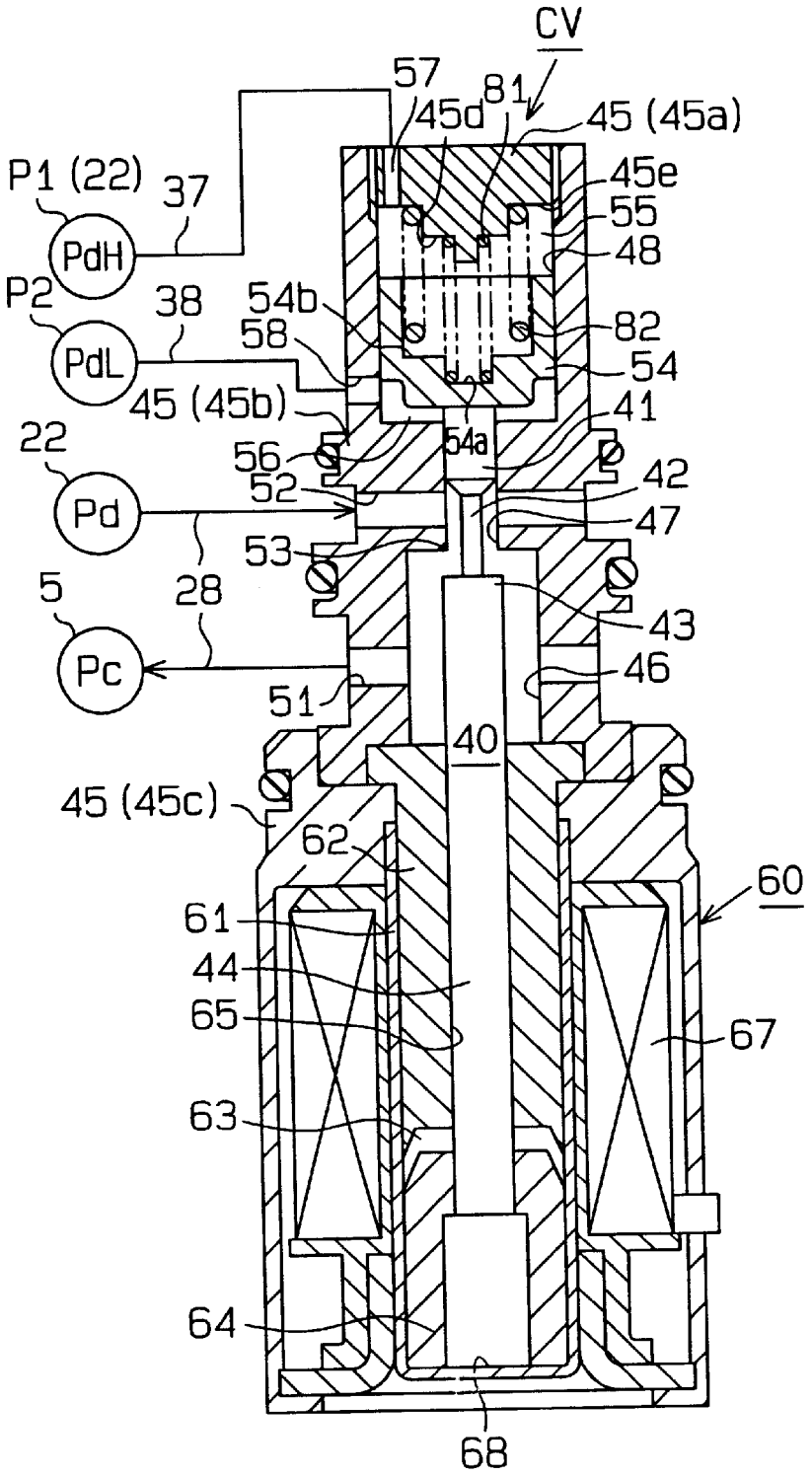
FIG. 7 is a cross-sectional view illustrating a control valve according to a second embodiment.

As shown in FIG. 7, the control valve CV may be modified such that the valve chamber 46 is connected to the crank chamber 5 through a downstream section of the supply passage 28, and the communication passage 47 is connected to the discharge chamber through an upstream section of the supply passage 28. This structure decreases the pressure difference between the second pressure chamber 56 and the communication passage 47 compared to the control valve CV of FIG. 3, and thus prevents gas leakage between the second pressure chamber 56 and the passage 47. Accordingly, the compressor displacement is accurately controlled.

Three or more springs for urging the pressure-sensing member 54 in one direction may be located in the pressure-sensing chamber 48.

The positions of the first and second pressure monitoring points P1, P2 are not limited to those illustrated in the drawings. That is, the pressure monitoring points P1, P2 may be any two locations in the refrigerant circuit, which includes the compressor and the external refrigerant circuit 30. For example, the pressure monitoring points P1, P2 may be located at any two locations in a high pressure zone, which includes the discharge chamber 22, the condenser 31 and the pipe 36.

Alternatively, the pressure monitoring points P1, P2 may be located at two locations in a low pressure zone, which includes the suction chamber 21, the evaporator 33 and the downstream pipe 35. For example, as indicated as modified embodiment in FIG. 2, the first pressure monitoring point P1 may be located in a section of the downstream pipe 35 between the evaporator 33 and the suction chamber 21, and the second pressure monitoring point P2 may be located in the suction chamber 21.

The first pressure monitoring point P1 may be located in the high pressure zone, which includes the discharge chamber 22, the condenser 31 and the pipe 36, and the second pressure monitoring point P2 may be located in the low pressure zone, which includes the evaporator 33, the suction chamber 21 and the downstream pipe 35.

Further, the first pressure monitoring point P1 may be located in the high pressure zone, and the second pressure monitoring point P2 may be located in an intermediate pressure zone, which is the crank chamber 5. Alternatively, the first pressure monitoring point P1 may be located in the crank chamber 5, and the second pressure monitoring point P2 may be located in the low pressure zone.

The control valve CV may be a so-called bleed control valve for controlling the crank chamber pressure Pc by controlling the opening of the bleed passage 27. In this case, the bleed passage 27 functions as a pressure control passage.

The present invention may be embodied in a control valve of a wobble type variable displacement compressor.

The present invention may be embodied in a refrigerant circuit that uses a clutch mechanism such as an electromagnetic clutch as the power transmission mechanism PT.

Therefore, the present examples and embodiments are to be considered as illustrative and not restrictive and the invention is not to be limited to the details given herein, but may be modified within the scope and equivalence of the appended claims.

What is claimed is:

1. A control valve for controlling the displacement of a variable displacement compressor used in a refrigerant circuit, wherein the compressor includes a crank chamber and a pressure control passage, which is connected to the crank chamber, the displacement of the compressor changes in accordance with the pressure in the crank chamber, and wherein the control valve adjusts the opening size of the pressure control passage, thereby controlling the pressure in the crank chamber, the control valve comprising:

a valve housing;

a valve body accommodated in the valve housing, wherein the valve body adjusts the opening size of the pressure control passage;

a pressure-sensing chamber defined in the valve housing;

a pressure-sensing member, which divides the pressure-sensing chamber into a first pressure chamber and a second pressure chamber, the first pressure chamber being exposed to the pressure at a first pressure monitoring point, which is located in the refrigerant circuit, the second pressure chamber being exposed to the pressure at a second pressure monitoring point, which is located in the refrigerant circuit, wherein the pressure at the first pressure monitoring point is higher than the pressure at the second pressure monitoring point, wherein the pressure-sensing member actuates the valve body in accordance with the pressure difference between the pressure chambers, thereby controlling the displacement of the compressor such that fluctuations of the pressure difference between the pressure chambers are cancelled;

a first urging member, which urges the pressure-sensing member from one of the pressure chambers toward the other one of the pressure chambers;

a second urging member, which urges the pressure-sensing member in the same direction as the first urging member urges the pressure-sensing member; and an actuator, wherein the actuator urges the pressure-sensing member by a force, the magnitude of which corresponds to an external command.

2. The control valve according to claim 1, wherein the actuator urges the pressure-sensing member in a direction opposite to the direction in which the first and second urging members urge the pressure-sensing member.

3. The control valve according to claim 2, wherein the first and second urging members urge the pressure-sensing member from the first pressure chamber toward the second pressure chamber.

4. The control valve according to claim 2, further comprising a stopper for limiting movement of the pressure-sensing member, wherein the first and second urging members urge the pressure-sensing member toward the stopper, wherein, when the pressure-sensing member is pressed against the stopper, movement of the pressure-sensing member is limited.

5. The control valve according to claim 4, wherein the first and second urging members urge the valve body toward the stopper through the pressure-sensing member, wherein, when the pressure sensing member is pressed against the stopper through the valve body, movement of the pressure-sensing member and the valve body is limited.

6. The control valve according to claim 4, wherein, when the pressure-sensing member is pressed against the stopper, the pressure-sensing member receives force only from the first urging member of the urging members.

7. The control valve according to claim 6, wherein, when the pressure-sensing member is away from the stopper by a distance that is equal to or greater than a predetermined distance, the pressure-sensing member receives forces from both urging members.

8. The control valve according to claim 5, wherein the pressure-sensing member moves the valve body between a maximum open position, at which the valve body maximizes the opening size of the pressure control passage, and a minimum open position, at which the valve body minimizes the opening size of the pressure control passage, and wherein, when the valve body is at the maximum open position, the pressure-sensing member and the valve body are pressed against the stopper.

9. The control valve according to claim 8, wherein, when the valve body is at the maximum open position, the pressure-sensing member receives force only from the first urging member of the urging members.

10. The control valve according to claim 9, wherein, when the valve body is between the maximum open position and an intermediate open position, which is away from the maximum open position by a predetermined distance, the pressure-sensing member receives force only from the first urging member of the urging members, and wherein, when the valve body is between the intermediate open position and the minimum open position, the pressure-sensing member receives forces from both urging members.

11. The control valve according to claim 10, wherein, when the actuator is not activated, the valve body is held at the maximum open position by the first urging member, and wherein, when the actuator is activated, the valve body is between the intermediate open position and the minimum open position.

12. The control valve according to claim 10, wherein, when the valve body is between the intermediate open position and the minimum open position, the displacement of the compressor is controlled between a minimum displacement and a maximum displacement, and wherein, when the valve body is between the maximum open position and the intermediate open position, the displacement of the compressor is minimized.

13. The control valve according to claim 1, wherein the first urging member is a first spring and the second urging member is a second spring, and wherein the spring constant of the first spring is smaller than the spring constant of the second spring.

14. The control valve according to claim 13, wherein the first spring always applies a substantially constant force to the pressure-sensing member.

15. The control valve according to claim 1, wherein the pressure control passage is a supply passage, which connects a discharge chamber of the compressor to the crank chamber.

16. A control valve for controlling the displacement of a variable displacement compressor used in a refrigerant circuit, wherein the compressor includes a crank chamber and a pressure control passage, which is connected to the crank chamber, the displacement of the compressor changes in accordance with the pressure in the crank chamber, and wherein the control valve adjusts the opening size of the pressure control passage, thereby controlling the pressure in the crank chamber, the control valve comprising:

a valve housing;

a valve body accommodated in the valve housing, wherein the valve body adjusts the opening size of the pressure control passage;

a pressure-sensing chamber defined in the valve housing;

a pressure-sensing member, which divides the pressure-sensing chamber into a first pressure chamber and a second pressure chamber, the first pressure chamber being exposed to the pressure at a first pressure monitoring point, which is located in the refrigerant circuit, the second pressure chamber being exposed to the pressure at a second pressure monitoring point, which is located in the refrigerant circuit, wherein the pressure at the first pressure monitoring point is higher than the pressure at the second pressure monitoring point, wherein the pressure-sensing member actuates the valve body in accordance with the pressure difference between the pressure chambers, thereby controlling the displacement of the compressor such that the pressure difference between the pressure monitoring points seeks a predetermined target value;

a first spring, which urges the pressure-sensing member from the first pressure chamber toward the second pressure chamber;

a second spring, which urges the pressure-sensing member in the same direction as the first spring urges the pressure-sensing member, wherein the spring constant of the second spring is greater than the spring constant of the first spring; and an electromagnetic actuator, wherein the actuator urges the pressure-sensing member by a force, the magnitude of which corresponds to an external command, wherein the actuator urges the pressure-sensing member in a direction opposite to the direction in which the springs urge the pressure-sensing member, and wherein the force of the actuator corresponds to the target value.

17. The control valve according to claim 16, further comprising a stopper for limiting movement of the pressure-sensing member and the valve body, wherein the first and second springs urge the valve body toward the stopper through the pressure-sensing member, wherein, when the pressure-sensing member is pressed against the stopper through the valve body, movement of the pressure-sensing member and the valve body is limited.

18. The control valve according to claim 17, wherein the pressure-sensing member moves the valve body between a maximum open position, at which the valve body maximizes the opening size of the pressure control passage, and a minimum open position, at which the valve body minimizes the opening size of the pressure control passage, and wherein, when the valve body is at the maximum open position, the pressure-sensing member and the valve body are pressed against the stopper.

19. The control valve according to claim 18, wherein, when the valve body is between the maximum open position and an intermediate open position, which is away from the maximum open position by a predetermined distance, the pressure-sensing member receives force only from the first spring of the springs, and wherein, when the valve body is between the intermediate open position and the minimum open position, the pressure-sensing member receives forces from both springs.

20. The control valve according to claim 16, wherein the first spring always applies a substantially constant force to the pressure-sensing member.

* * * * *